US005437732A

United States Patent [19]

Igarashi et al.

[11] Patent Number: 5,437,732

[45] Date of Patent: Aug. 1, 1995

[54] DUST COLLECTOR/REMOVER IN KNITTING MACHINE AND ITS CONTROLLING METHOD

[75] Inventors: Yoshiaki Igarashi; Kosaku Iida, both of Hyogo, Japan

[73] Assignee: Precision Fukuhara Works, Ltd., Kobe, Japan

[21] Appl. No.: 148,327

[22] Filed: Nov. 8, 1993

Related U.S. Application Data

[62] Division of Ser. No. 940,512, Sep. 4, 1992.

[30] Foreign Application Priority Data

Sep. 5, 1991 [JP] Japan ..... 3-254391

[51] Int. Cl.[6] ..... D04B 35/32; B08B 5/04

[52] U.S. Cl. ..... 134/21; 15/301; 15/319; 66/168

[58] Field of Search ..... 15/301, 319; 66/168; 134/21

[56] References Cited

U.S. PATENT DOCUMENTS

| | | | |
|---|---|---|---|
| 2,976,668 | 3/1961 | Reiterer | 134/21 X |
| 3,459,010 | 8/1969 | Ferri | 66/168 |
| 3,461,693 | 8/1969 | Klaeui | 66/168 |
| 3,471,890 | 10/1969 | Ramo | 15/301 |
| 3,628,213 | 12/1971 | Ramo | 15/301 X |
| 3,839,764 | 10/1974 | Clayton | 15/301 |
| 5,154,045 | 10/1992 | Saruwatari et al. | 15/301 X |
| 5,177,985 | 1/1993 | Igorashi et al. | 66/168 |
| 5,201,793 | 4/1993 | Izumi et al. | 66/168 |

FOREIGN PATENT DOCUMENTS

| | | |
|---|---|---|
| 1216120 | 4/1960 | France . |
| 2087543 | 5/1982 | United Kingdom . |

*Primary Examiner*—Chris K. Moore

*Attorney, Agent, or Firm*—Bell, Seltzer, Park & Gibson

[57] ABSTRACT

Mutually spaced fiber waste collectors upon the knitting machine and creel of a knitting unit collect fiber waste which is then withdrawn by a fiber waste remover that is selectively connectable to different ones of the fiber waste collectors. Sensors detect when the fiber waste collected by the collectors exceeds a predetermined amount.

8 Claims, 17 Drawing Sheets

Fig. 6.
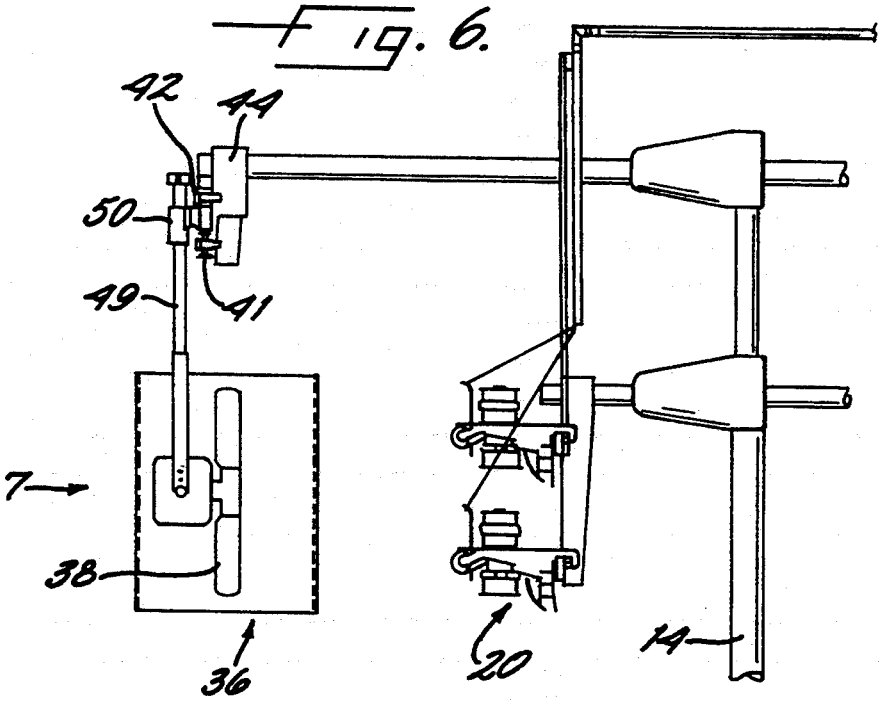
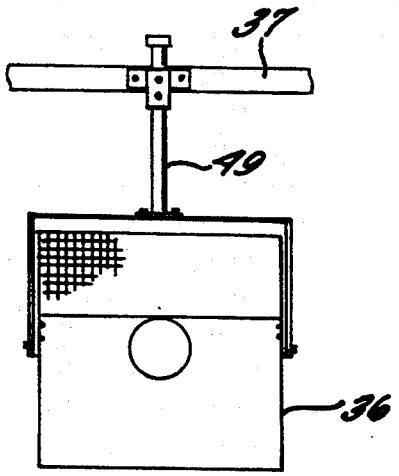
Fig. 7.

DUST COLLECTOR/REMOVER IN KNITTING MACHINE AND ITS CONTROLLING METHOD

CROSS-REFERENCE TO RELATED APPLICATIONS

This application is a division of application Ser. No. 07/940,512 filed Sep. 4, 1992.

Some of the subject matter disclosed in the present application is also disclosed in commonly owned and co-pending U.S. patent application Nos. 07/869,305; 07/869,307; and 07/869,460, and the disclosures of such applications are incorporated herein by reference.

FIELD OF THE INVENTION

This invention relates to an apparatus and method for collecting and removing lint, dust and the like, hereinafter referred to as fiber waste, by suction from a knitting machine and its associated creel stand.

BACKGROUND OF THE INVENTION

The number of yarn supply bobbins associated with a knitting machine may number from several to over 100. Particularly when the fiber being knitted is made from cotton yarn, the fiber waste generated by engagement between the yarn and the yarn feeding and guiding devices of the knitting machine is quite substantial. The fiber waste problem is further aggravated by the fact that knitting machines tend to be operated at increasingly faster speeds, which increases the rate and amount of fiber waste generation.

After fiber waste has become airborne, it may settle upon the yarn feeding and guiding devices or other components of the knitting section of the knitting machine where it was generated, or upon one or more neighboring machines. This increases the possibility of yarn breakage, defective stitches, and general degradation of the quality of the knitted fabric.

Previously proposed apparatuses for removing fiber waste from circular knitting machines have employed fans or air blowers located above the machines. However, these merely displace the fiber waste from one location to another and do not collect the waste. It has also been proposed to enclose each of the knitting machines in a curtain-like sheet, and to provide adjacent each machine an exhaust duct into which a machine operator may introduce the fiber waste generated by the machine and collected by the operator. Providing separate exhaust ducts in association with each of the knitting machines is quite expensive, however. Additionally, the curtain-like sheets limit access to the knitting machines, and rapidly become unsanitary due to adherence of lint, oil, dirt and the like to them.

Fiber waste cannot be efficiently collected by merely blowing fiber waste by a fan, blower or the like, as in the prior art.

Commonly assigned Japanese patent application No. Hei 3-119439 discloses filtering means for collecting fiber waste generated at the knitting section (yarn carrier part, sinker part, sinker cap part, and knitting needle part) of a circular knitting machine; and also filtering means for collecting fiber waste generated at the yarn feeding device, yarn guide section and end breakage failure detection device, etc., above the knitting section.

Commonly assigned Japanese patent application No. Hei 3-116851 discloses a fiber waste box for collecting fiber waste generated at the knitting section (yarn carrier part, sinker part, sinker cap part, and knitting needle part).

Commonly assigned Japanese patent application No. Hei 3-116850 discloses a filter means for collecting fiber waste generated at the creel stand in which are housed the bobbins that supply the yarn for knitting the fabric.

The above-noted filter means and fiber waste box (generically called "fiber waste collectors") have fiber waste removers which are independent from each other. This makes the power distribution network more complex, and causes inefficient utilization of plant space. Moreover, effecting fiber waste collection by operating collectors at different locations without consideration of whether the amount of fiber waste generated at such locations is small or large, may and usually will result in excessive power consumption.

SUMMARY OF THE INVENTION

An object of the present invention is to reduce energy consumption by centrally withdrawing fiber waste generated at various locations into a single fiber waste remover. Another object of the invention is to conduct fiber waste from each collector quasi-periodically or non-periodically, depending on the amount of fiber waste collected at each collector.

The invention provides an apparatus and method for collecting and removing fiber waste generated adjacent the knitting section of a knitting machine and one or more creel stands adjacent the machine. The apparatus and method utilizes three types of collectors: a top collector located above the knitting section of the knitting machine; a bottom collector adjacent the knitting section of the knitting machine; and at least one creel collector. A single fiber waste remover services the three collectors.

In one embodiment thereof, the top collector preferably includes a suction/blowing means located centrally of and above the knitting section of a knitting machine, filter means located above the suction/blowing means, filter means, driving means for rotating the filter means, when appropriate, and a suction duct located below the suction/blowing means. In another embodiment the top collector for collecting and removing fiber waste from the knitting machine preferably includes a suction/-blowing means located centrally above the knitting section, filter means above the suction/blowing means, filter driving means for rotating the filter means, and a suction duct disposed beneath the suction/blowing means.

The bottom collector preferably includes an air ejection nozzle for blowing fiber waste downwardly from a location above the sinkers toward the needle grooves of the needle cylinder, a fiber waste collection box adjacent the rotary cylinder and a sinker dial, and a suction nozzle and duct for removing the fiber waste from the waste collection box.

The creel fiber waste collector preferably includes a first rotatable filter means adjacent the central part of the creel stand, blowing means below the first filter, an exhaust duct located above the blowing means, a shielding member adjacent the top of the creel and causing the air flow to change direction, another shielding member over at least part of the side of the creel, and driving means for rotating the aforesaid first filter.

The fiber waste remover preferably has a multiposition change-over valve and means for electrically controlling such valve. Preferably the fiber waste remover includes controllers for controlling the time and sequence of fiber waste removal from different ones of the collectors, and for controlling the operation of fan and/or drive motors associated with various ones of the fiber waste collectors. The fiber waste remover also includes means for moving its change-over valve to different positions in response to the detection by sensors of the quantities of fiber waste collected by different ones of the fiber waste collectors.

The invention also provides a method of controlling and effecting the collection/removal of fiber waste, which method includes the step of switching the suction forces generated by the fiber waste remover apparatus between desired ones of a plurality of suction openings which are respectively connected to three types of fiber waste collectors, e.g., a top collector located above the knitting section of the knitting machine, a bottom collector adjacent the knitting section of the machine, and at least one creel collector. When any one of the three collectors is connected with the remover apparatus, fiber waste is sucked from such collector into the remover apparatus.

Each fiber waste collector preferably has an associated sensor for determining the amount of fiber waste collected, so that when a particular sensor detects the collection of a predetermined amount of fiber waste by the associated collector, the collected fiber waste is withdrawn into the remover for a time period correlated to the amount of the fiber waste collected by the collector.

Since the fiber waste collected by the three types of collectors (e.g., the top collector located above the knitting section of the knitting machine, the bottom collector adjacent the knitting section of the knitting machine, and at least one creel collector) may be withdrawn into a single remover apparatus, it is possible to simplify the power and fiber waste removal systems.

By switching between a plurality of suction opening positions of the fiber waste remover, a particular collector is specifically selected for fiber waste removal, so that the collected fiber waste may be withdrawn from the selected collector into the removal apparatus for the time period necessary for withdrawal of the fiber waste collected by the filter of such collector. This produces energy savings, as well as high efficiency. The switching may be done periodically or when predetermined amounts of fiber waste have been collected in each collector. Particularly in the latter instance, substantial energy savings are realized.

DESCRIPTION OF THE DRAWINGS

Other features of the invention will be apparent from the following description of illustrative embodiments thereof, which should be read in conjunction with the accompanying drawings, in which:

FIG. 6 is an enlarged side elevational view of the blowing means that undergoes reciprocal movement along a path of travel outside of the yarn feeding devices of the knitting machine;

FIG. 7 is a front elevational view of the blowing means of FIG. 6, as viewed in the direction of the arrow 7 of FIG. 6;

DESCRIPTION OF THE PREFERRED EMBODIMENTS

Figure 1:
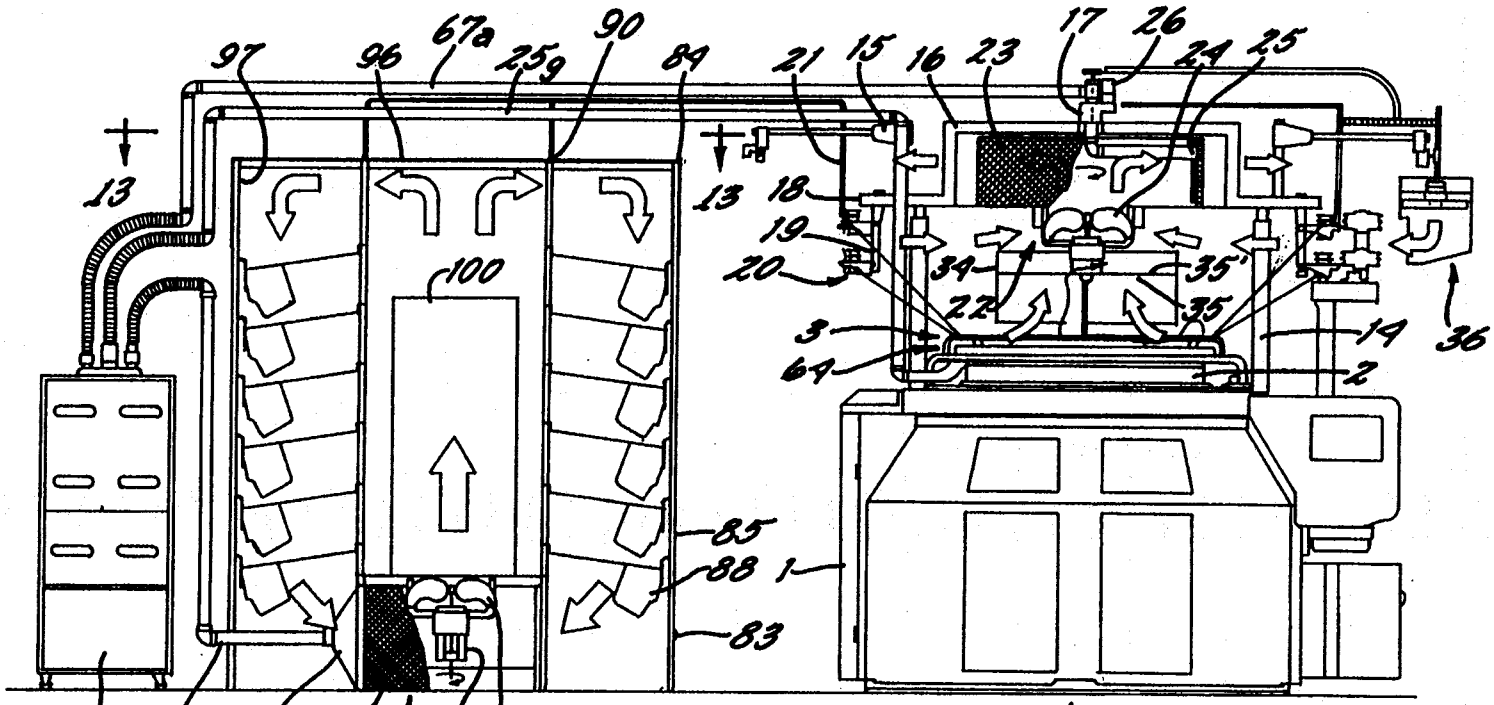
FIG. 1 is a front elevational view of a knitting unit having a circular knitting machine and creel stand equipped with three types of fiber waste collectors and a single fiber waste remover in accordance with the invention.
Figure 2:
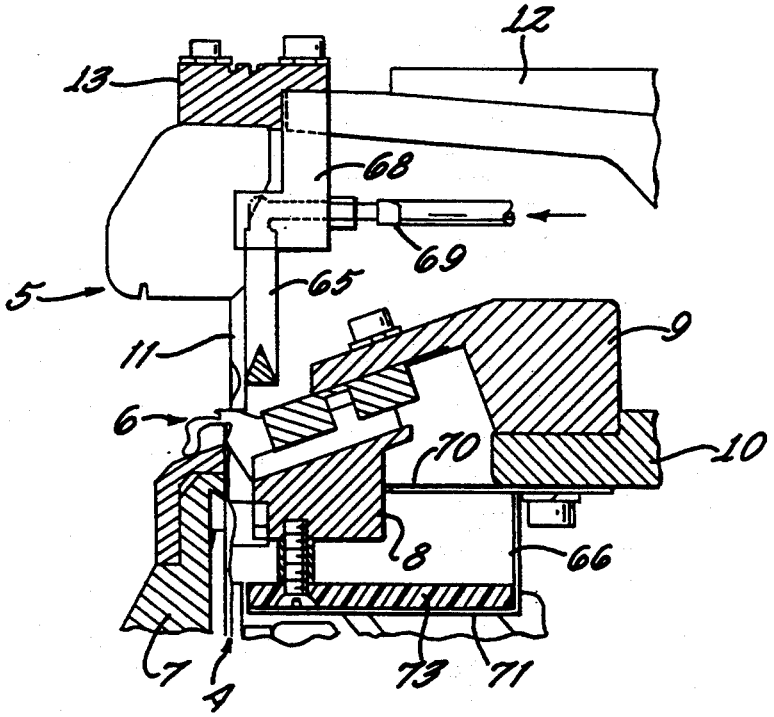
FIG. 2 is an enlarged sectional view of components of the knitting section of the knitting machine.

FIG. 1 of the drawings shows a knitting unit that includes a circular knitting machine A and adjacent creel stand B which are equipped with apparatus for collecting and removing fiber waste from the machine and creel stand. Machine A has a knitting section 3 above a bed 2 that is supported by a plurality of legs 1. As is best shown in FIG. 2, knitting section 3 includes a needle cylinder part 4, a yarn carrier part 5, and a sinker part 6. In the needle cylinder part 4, knitting needles are freely slidable in a vertical direction along a needle groove formed on the periphery of rotating cylinder 7. Cylinder 7 is rotated at desired speeds by gearing (not shown in FIG. 2) below the cylinder.

Sinker part 6 includes sinkers that are freely slidable in a radial direction along a plurality of sinker grooves within sinker dial 8. Sinker part 6 further includes a sinker cap 9 that is supported via a sinker cap ring 10 by a lower support (not shown in FIG. 2) upon bed 2.

Yarn carrier part 5 includes a yarn carrier 11 that feeds yarn to a knitting needle. Carrier 11 is connected to a yarn carrier ring 13 via a yarn carrier ring support 12 located above sinker part 6.

Referring now once again to FIG. 1, a plurality of posts 14 that extend upwardly from bed 2 have their upper end portions secured via coupling members 15 to horizontal members 16. Members 16 are connected to a central coupling member 15 at their radially inner ends. A bracket 19 is mounted upon each post 14 by a support 18. Brackets 19 support yarn feeding devices 20 at upper and lower positions adjacent respective yarn feeders. Yarn is fed from the neighboring creel stand B (shown at the left side of FIG. 1) to each yarn feeding device 20 through a yarn introducing pipe 21.

Machine A and creel stand B are equipped with a plurality (illustratively three) of fiber waste collectors. These illustratively are a top collector 22, a bottom collector 64, and a creel collector 98.

Top fiber waste collector 22 is located above knitting section 3 of machine A. The construction of collector 22 is substantially the same as that disclosed in commonly owned U.S. patent application Ser. No. 07/869,460. Collector 22 includes a fixed cylindrical filter 23, a motor driven fan 24, filter collector means 25 which rotates adjacent the inner wall of filter 23; and collector means driving means 26 for imparting rotation to collector means 25. Filter 23 may be constructed of two or more parts that are assembled preparatory to use. A large number of mesh-like perforations open through the surface of filter 23. Preferably, there are 20–40 perforations per square inch, and more preferably 30 perforations per square inch. In lieu of the aforesaid filter, wire nets or punched steel plates having comparable perforations may be employed.

Filter 23 has its bottom portion fixedly secured to a circular plate 27 that extends to a location adjacent the upper yarn feeding devices 20 of machine 10. Plate 27 has a central opening 28 beneath which a motor driven fan 24 is supported by plate 27. Fan 24 produces air flow in the direction of the arrows shown in FIG. 1.

Figure 3:
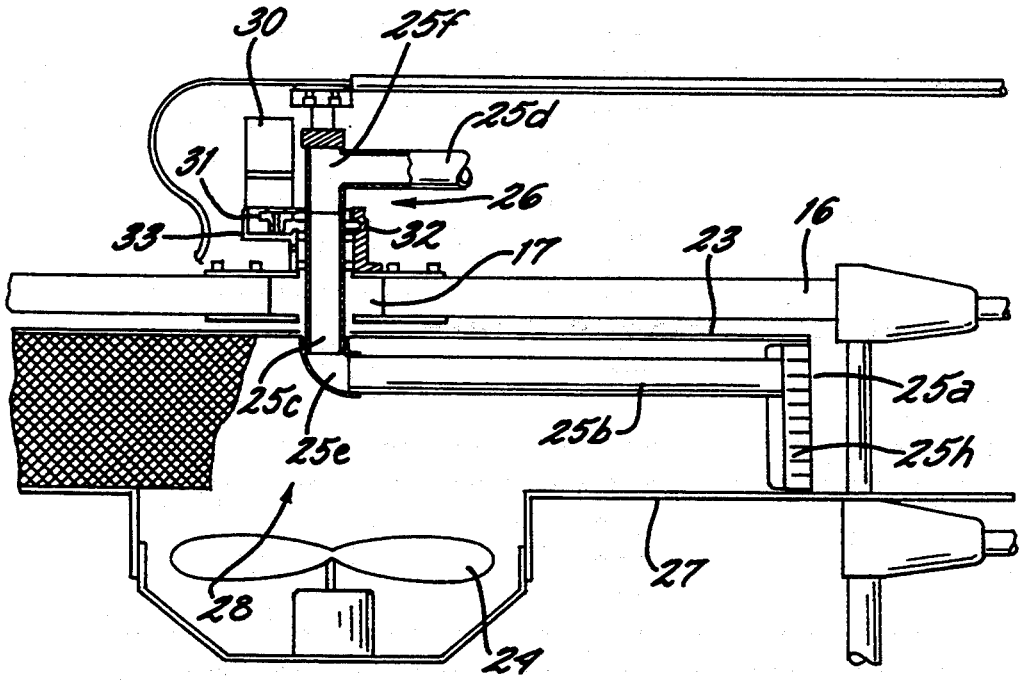
FIG. 3 is a fragmentary sectional view showing a top collector and associated drive and power distribution components.
Figure 4:
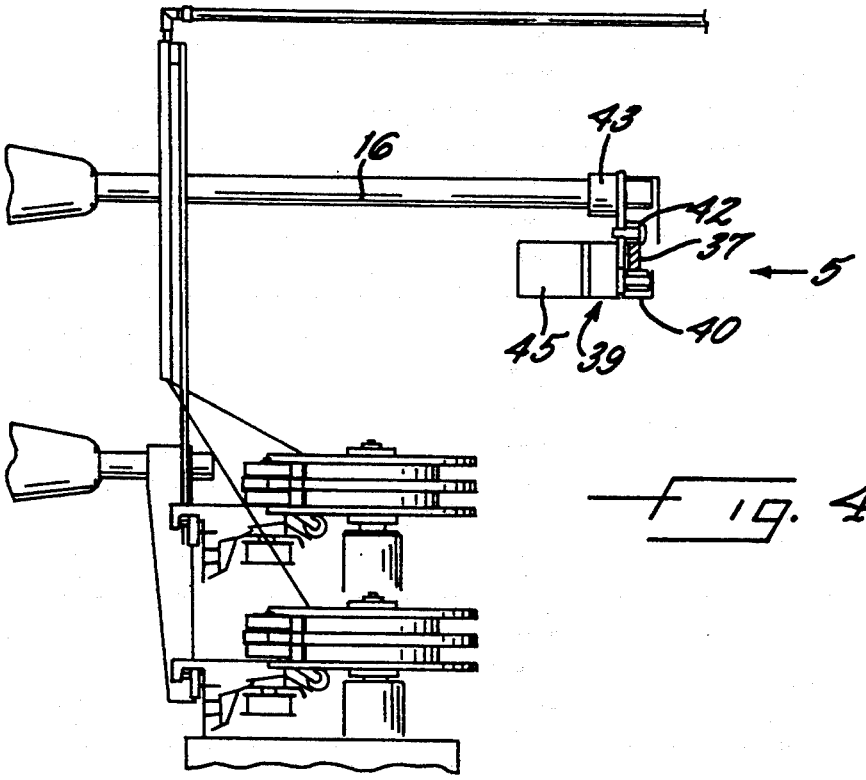
FIG. 4 is a fragmentary elevational view of drive means for a blower associated with the knitting machine.

As is best shown in FIG. 3, filter collector means 25 includes a pipe having a "tip" or inlet opening 25*a*, a first horizontal section 25*b*, a vertical section 25*c* extending along the machine axis and projecting through the top of the knitting machine, a second horizontal section 25*d*, a connecting elbow-like section 25*e*, and a T-shaped section 25*f*. Collector means 25 further includes a flexible tube 25*g* that extends to a fiber waste remover 120 located outwardly from machine A and creel B. Tip opening 25*a*, horizontal part 25*b*, vertical part 25*c* and elbow 25*e* are rotated with each other by driving means 26 of collector means 25, but T-shaped pipe 25*f* and a second horizontal member 25*d* are fixed in place above driving means 26. A comb member 25*h* attached to tip opening 25*a* gathers the fiber waste that accumulates on the inside wall of filter 24. The height of comb member 25*h* is almost equal to the height of filter 23. Collector means 25 is connected by a tube to a fiber waste remover 120 located outside of the knitting machine.

The driving means 26 for rotating collector means 25 includes a motor 30 having an output spur gear 31. Motor 30 is supported by center member 17 via a motor stand 33. The motor's gear 31 meshes with a second gear 32 mounted on the periphery of vertical part 25*c* of collector means 25. Accordingly, operation of the gear motor causes rotation of the collector means components from part 25*c* to tip opening 25*a*. Tip opening 25*a* and comb 25*b* effect fiber waste removal while rotating adjacent the inside wall of filter 23. Motor 30 runs periodically at a low speed in accordance with the setting of a timer or other control member.

Referring now again to FIG. 1, a cylindrical suction duct 34 extends downwardly from motor fan 24 to a location adjacent the upper part of cylinder 7 of the knitting machine. Duct 34 is supported by stays 35 extending from posts 14 toward the center of the knitting machine. A shielding member 35' preferably is provided adjacent the upper part of cylinder 34. Member 35' separates the cylinder into upper and lower areas so as to provide a desired path for an air flow generated by a subsequently described blowing means 36.

When motor fan 24 is energized, air is blown upwardly as indicated by the lower arrows in FIG. 1. Fiber waste is generated above the rotary cylinder 4 as yarn engages the needles and sinkers during its formation into stitches. Such fiber waste is conducted upwardly by the air stream and adheres to the inside wall of filter 23. The fiber waste accumulating on the inside wall of filter 23 is then sucked away through tip opening 25*a* of the filter collector means as the same is rotated by driving means 26.

Figure 5:
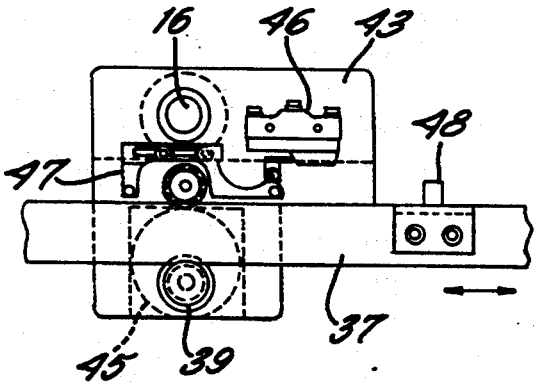
FIG. 5 is a front elevational view of the drive means and adjacent components shown in FIG. 4, as viewed in the direction of the arrow 5 of FIG. 4.

Blowing means 36 is located outside the yarn feeding devices 20. As is best shown in FIGS. 4–7, blowing means 36 includes a rotary ring 37, a motor driven fan 38 supported by the rotary ring, and motor driven drive means 39 that imparts rotary movement to ring 37. Ring 37 is located immediately below the tip portion of each horizontal member 16, and is supported for rotation by supporting rollers 40, 41. Guide rollers 42 control upward and downward movement of rotary ring 37. Each supporting roller 40 and guide roller 42 are rotatively mounted on respective brackets 43, 44 which are themselves mounted on the tip portion of each horizontal member 16. Bracket 43 mounts a gear motor 45 having an output shaft upon which a supporting roller 40 is mounted. Operation of motor 45 imparts rotation to ring 37 by reason of the ring's frictional engagement with roller 40. As best shown in FIG. 5, bracket 43 also supports a limit switch 46 and a switch cam 47 which actuates the limit switch and is movable along the rotary ring 37. A protruding member 48 which moves switch cam 47 is attached to rotary ring 37. At least one motor driven fan 38 is mounted upon rotary ring 37 so as to face yarn feeding devices 20, as shown in FIGS. 6 and 7. Fan 38 is supported by a bracket 50 through which a vertical shaft 49 is vertically adjustable. Bracket 50 is mounted on the outer periphery of ring 37.

In the aforesaid construction, fan 38 of blowing means 36 moves with rotary ring 37. As an alternative, however, only fan 38 may undergo movement. In the latter case, rotary ring 37 is stationary and motor 45 and fan 48 are integrally connected for movement along and about ring 37.

As an alternative to use of the blowing means 36, an air ejection pipe such as disclosed in Japanese Patent Publication No. Hei 1-38899 may be employed. The aforesaid air ejection pipe conducts a jet of air through its tip opening to a nozzle made of an elastic material that is so mounted as to make a wobbling motion. Means for controlling the angle of the wobbling motion may be provided. The air ejection pipe is located so as to face yarn feeding devices 20 and is rotated with the rotary ring 37. The air discharged from the pipe blows away fiber waste generated at yarn feeding devices 20.

A system for distributing power to the motor fan 38 on rotary ring 37, and for causing at desired times its reciprocal motion, includes a bearing housing 51, hollow pipe 52 and an expansion pipe 53.

Figure 8:
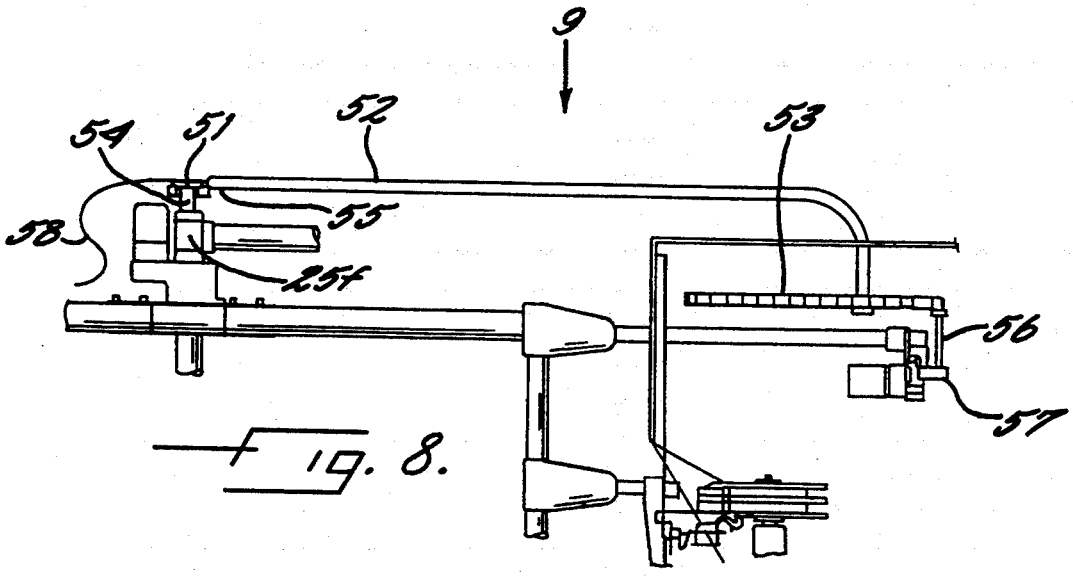
FIG. 8 is a side elevational view of components of the power distribution system for the blowing means.
Figure 9:
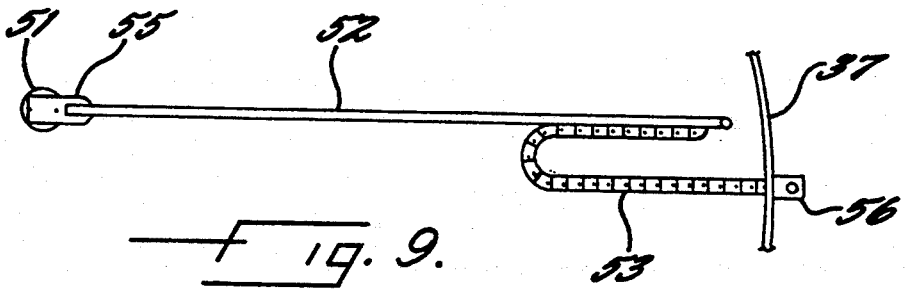
FIG. 9 is a top plan view of components of FIG. 9, as viewed in the direction of the arrow 9 of FIG. 8.

Bearing housing 51 is connected through a shaft section 54 joined to T-shaped pipe section 25*f*. A pipe fitting 55 is rotatably attached to bearing housing 51. A hollow pipe 52 connected to and extending radially from pipe fitting member 55 has a downwardly extending outer end portion above rotary ring 37. The vertical portion of hollow pipe 52 is coupled to one end of expansion pipe 53. The other end of expansion pipe 53 is attached to the upper portion of a vertical shaft 56 that is mounted via a bearing 57 on one side of rotary ring 37. The wiring 58 (FIG. 8) to motor fan 38 is routed through hollow pipe 52, expansion pipe 53 and, thereafter, to motor fan 38.

When the above-described blowing means 36 is energized, rotary ring 37 is rotated by supporting roller 40 of gear motor 45. Each time rotary ring 37 rotates through 360°, protruding member 48 abuts and moves switch cam 47. Movement of switch cam 47 actuates limit switch 46 and causes reversal of gear motor 45, which in turn causes rotary ring 37 to reverse its direction of rotation The fan 38 supported by rotary ring 37 undergoes reciprocal movement in a circumferential direction, accompanying the rotation of rotary ring 37. The expansion pipe 53 and hollow pipe 52 which house the wiring 58 follow the movement of fan 38.

Fan 38 blows the fiber waste generated at the yarn feeding devices 20 toward filter 23. This causes the fiber waste generated at the yarn feeding devices to be attracted to filter 23 and to be deposited upon the inner wall thereof.

Figure 10:
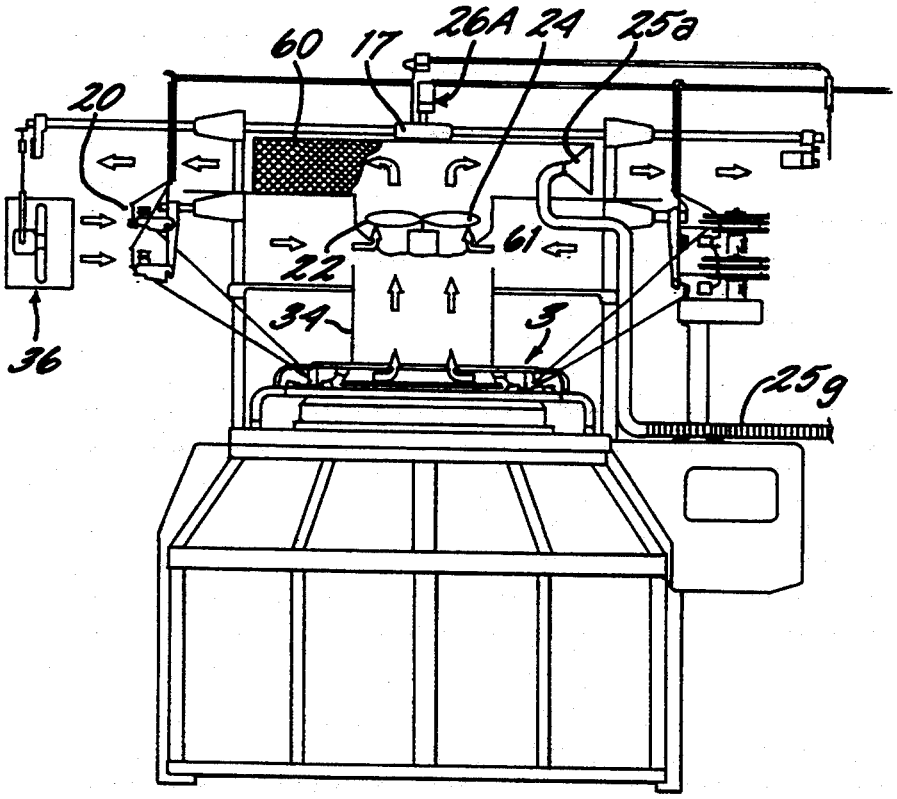
FIG. 10 is a front elevational view of a circular knitting machine equipped with a second type of top collector in accordance with the invention.

FIG. 10 shows in front elevation a circular knitting machine equipped with a top fiber waste collector of a second embodiment. The top collector of FIG. 10 resembles the collector of the first embodiment in overall construction. In contrast to the top collector of the first embodiment, however, the top collector of FIG. 10 rotates and the tip opening 25*a* through which the fiber waste is sucked remains in a fixed position adjacent the inside wall of filter 60. Thus, the relationship between filter 60 and tip opening 25*a* is reversed from that relationship of the first embodiment. The bottom part of filter 60 is not secured to the circular plate underlying such filter, as a result of which filter 60 may be rotated by filter drive means 26*a*. As in the first embodiment, when the motor fan 24 of FIG. 10 is energized, air and entrained fiber waste are blown upwardly.

A second fiber waste collector 64 (hereinafter referred to as a bottom collector) is particularly suitable for removing fiber waste generated and accumulating adjacent knitting section 3 of the knitting machine. More specifically, bottom collector 64 efficiently collects fiber waste generated at a location adjacent where the yarn is formed into stitches by the knitting needles and sinkers of the knitting machine. The construction of the aforesaid bottom collector is similar to that disclosed in commonly owned U.S. patent application Ser. No. 07/869,307.

Figure 11:
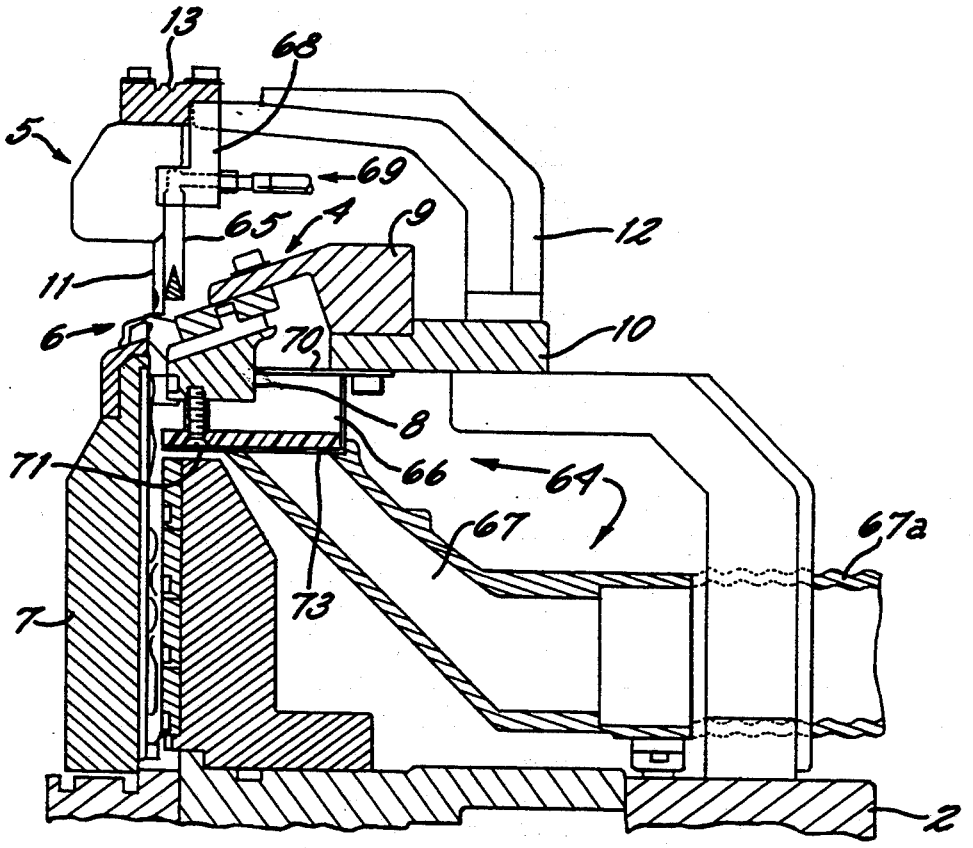
FIG. 11 is a view partially in vertical section and partially in side elevation of a bottom collector in accordance with the invention, and of adjacent knitting section components of the knitting machine of FIG. 10.

As is best shown in FIG. 11, the bottom collector 64 includes an air ejection nozzle 65, a fiber waste box 66 disposed below the ejection nozzle, and a suction nozzle 67 and suction duct 67*a* for sucking collected fiber waste from box 66.

The generally flat tip of air ejection nozzle 65 directs air downwardly from above sinker 4 toward the needle grooves so as to entrain fiber waste generated at the needles, sinkers, yarn carrier, etc. Nozzle 65 is connected to yarn carrier ring 13 via a bypass nozzle 68. An air intake 69 interconnects bypass nozzle 68 and a compressed air source (not shown).

Fiber waste box 66 includes an upper shielding plate 70 and a shielding member 71 of generally L-shaped configuration. Members 70, 71 are secured to the bottom of an annular ring 10. The smaller diameter portion of upper shielding plate 70 is adjacent the periphery of sinker dial 8. The outer edge of the lower section of L-shaped plate member 21 is adjacent the periphery of cylinder 7.

Figure 12:
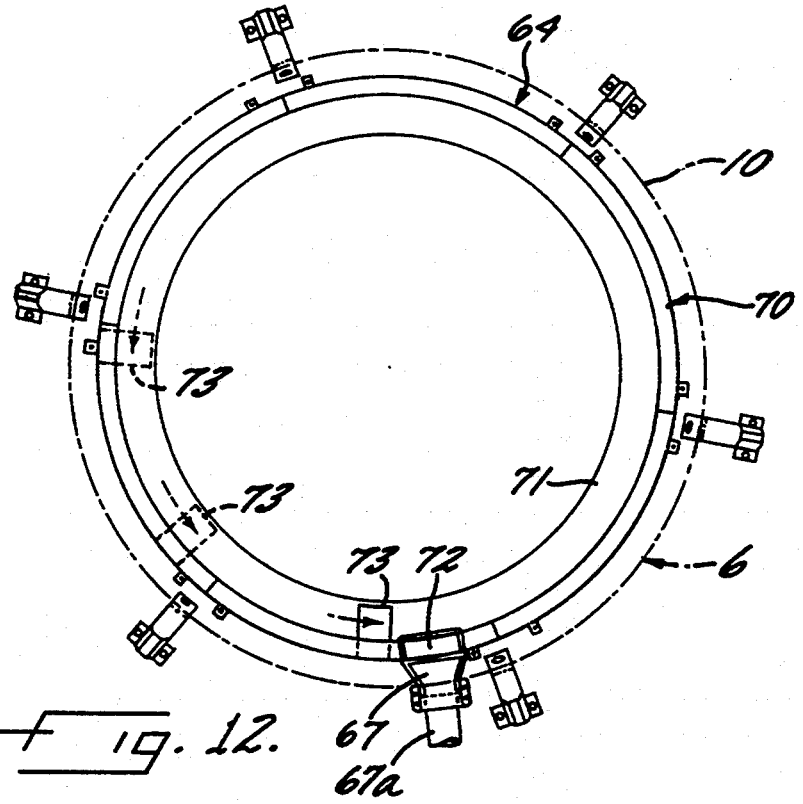
FIG. 12 is a bottom plan view of a fiber waste collection box of the knitting machine of FIG. 10.
Figure 13:
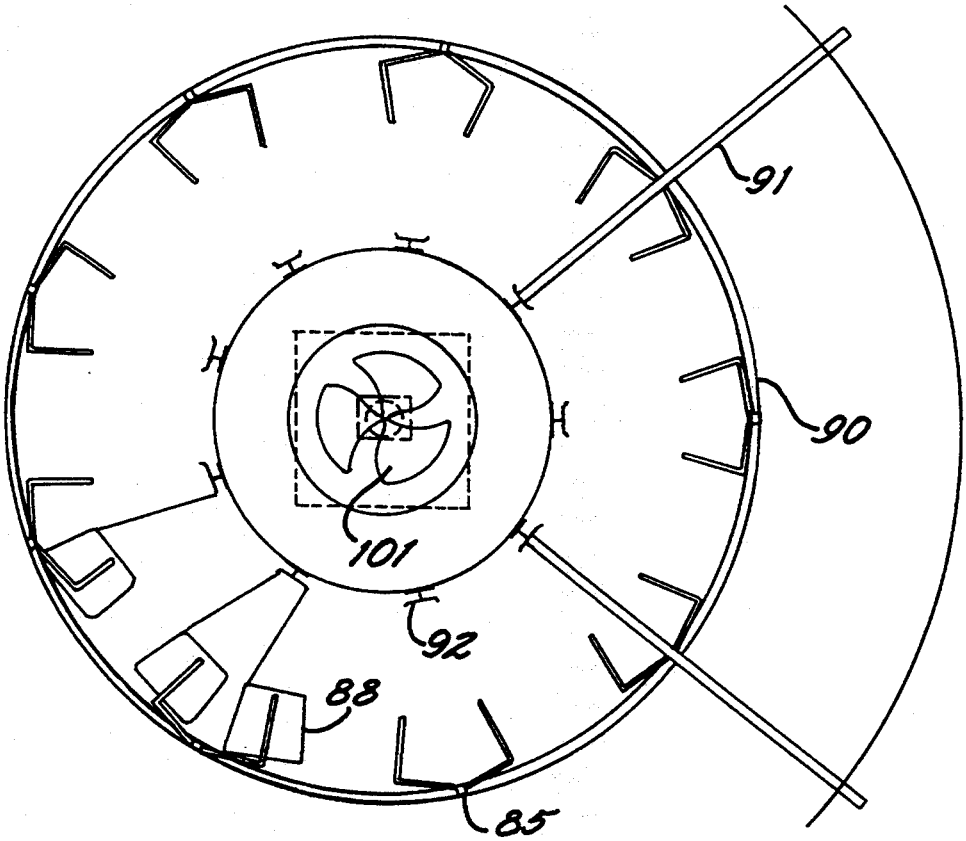
FIG. 13 is a plan view of the circular creel stand of the knitting unit, as viewed in the direction of the arrows 13—13 of FIG. 1.

The shielding member 71 with an L-shaped configuration is, as shown in FIG. 12, divided into several sectors, within one of which an opening 72 is provided. Suction nozzle 67 is located beneath opening 72 and is aligned with air ejection nozzle 65.

A member 73 formed of rubber or the like is housed within box 66. Member 73 is adapted to collect the fiber waste blown into the box by air ejection nozzle 65. Member 73 is secured to the bottom of sinker dial 8 by means of a bolt, or other suitable fastener, so as to undergo rotation in unison with the sinker dial. Member 73 extends substantially the entire distance between the radially inner and radially outer edges of the lower part of shielding member 71, and may have a length of approximately 5–10 mm. While one member 73 is normally sufficient, a plurality of them may if desired be installed upon the lower part of member 71.

The fiber waste gathered by member 73 is discharged from box 66 through opening 72 into the suction nozzle 67 disposed below opening 72. Nozzle 67 is securely but releasably attached to the bed of the knitting machine by means of a magnet, or the like, and is connected via a flexible tube 67*a* to the fiber waste remover 120 located outside of the machine.

Figure 15:
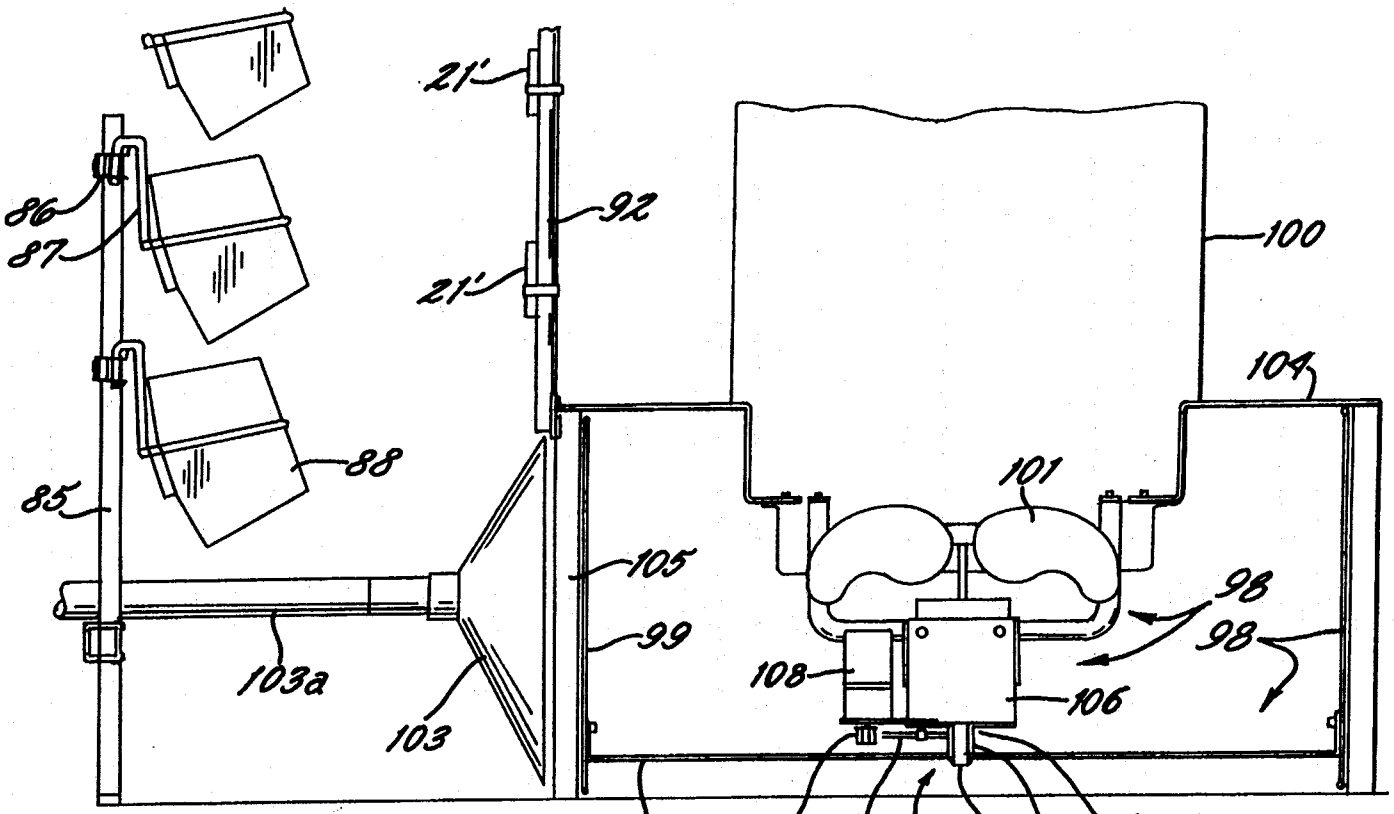
FIG. 15 is an enlarged view, partially in elevation and partially in vertical section, of creel and creel collector components of the knitting unit.

Referring once again to FIG. 1, the circular creel stand B adjacent knitting machine A has large diameter rings 83, 84 adjacent its lower and upper ends, respectively, and also has a plurality of vertical supporting members 85 that are connected to and spaced at equal intervals about the circumference of the rings. As is best shown in FIG. 15, each supporting member 85 has a bobbin holder 6 that is fixed to the supporting member and that has a stem 87 upon which a bobbin 88 is mounted for pivotal movement.

A smaller diameter ring 90 within the center portion of creel stand B is radially spaced from the larger diameter ring 83 and is connected to it by radially extending horizontal members 91.

Figure 14:
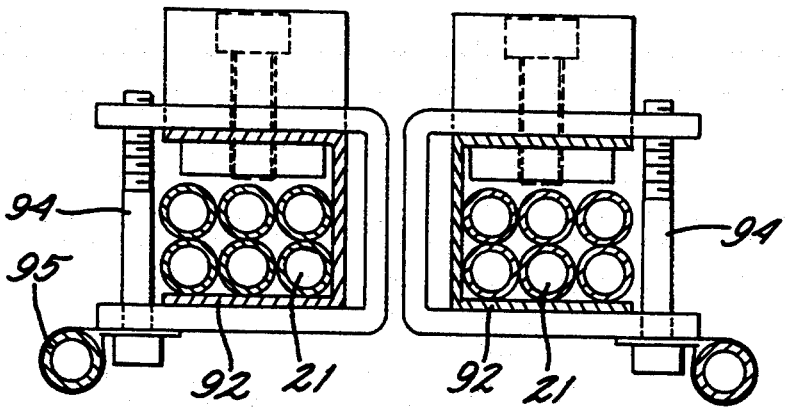
FIG. 14 is an enlarged view, partially in elevation and partially in section, of yarn introducing pipes within channel members shown in FIG. 13.

A plurality of channel members 92 are spaced at equal intervals from each other about the circumference of ring 90, and extend parallel to the central axis of creel stand B. As is best shown in FIG. 14, a plurality of yarn guiding pipes 21 are received within channel members 92. At the open side of each channel a bolt 94 prevents movement of the yarn guiding pipes from the channel. A band 95 connected to the lower end of each bolt 94 causes pipes 21 to face bobbins 88. Each yarn guiding pipe 21 has an inlet fitting 21' (FIG. 15) that is made of porcelain or the like. Yarn unwound from a bobbin 88 is directed into an adjacent fitting 21' and then is conducted to knitting machine A through yarn guiding pipe 21.

Soft vinyl or similar sheet material (not shown) overlies the top board or plate 96 of creel stand B, and also shields at least the upper part 97 of the creel stand.

A third fiber waste collector 98, which hereinafter is sometimes referred to as a creel collector, is located within the central part of creel stand B. Collector 98 is of substantially the same construction as that of the collector disclosed in commonly owned U.S. patent application Ser. No. 07/869,305. It includes (see FIG. 15) a cylindrical filter 99, an exhaust duct 100, a motor driven fan 101, drive means 102 for rotating the filter, and a suction nozzle 103.

While exhaust duct 100 is illustratively and preferably a circular cylinder, it may instead be of square, rectangular or other shape in cross-section. Duct 100 is mounted on a circular frame 104 which has a diameter greater than that of the exhaust duct and which has a stepped section between the exhaust cylinder and the encircling circular frame. The bottom portion of previously-mentioned channel member 92 is secured to the periphery of frame 104, and a plurality of legs 105 support the frame. A motor driven fan 101 within the upper part of frame 104 moves air, when activated, upwardly through duct 100.

The drive means 102 for rotating filter 99 underlies fan 101. A bracket 106 upon the motor of fan 101 supports a vertical shaft 107 and a gear motor 108. Motor 108 is controlled by a timer or the like so as to operate at preselected intervals at relatively slow speeds. A pulley 109 upon the output shaft of motor 108 imparts rotation via a drive belt 110 to a second pulley 112 that is integral with a member 111 that encircles and is rotatable about shaft 107.

Four radially extending arms 113 are connected, as by snap rings or the like, at their inner ends to rotatable member 111. A cylindrical filter 99 is mounted upon vertically extending flanges adjacent the outer ends of arms 113. The installed height of filter 99 in this embodiment is nearly equal to the height of circular frame 104. The filter may be comprised of two or more parts which are assembled prior to use. A large number of perforations extend through the surface of the filter. There preferably are 20–40 perforations per inch, and more preferably 30 perforation per inch. In lieu of the aforesaid filter, wire net or punched steel plates having perforations of the aforesaid size may be used. When motor driven fan 101 is energized, air is blown upwardly as shown by the central arrow in FIG. 1. Upon reaching the upper portion of the creel stand, the air engages top panel 96, which causes the air to pass generally radially outwardly. Upon reaching the outer portion of the creel stand, the shielding side wall depending from top border panel 96 causes the air to flow downwardly. The aforesaid air entrains fiber waste generated adjacent bobbins 88 and the inlet fittings 21' of the yarn introducing pipes 21. This entrained fiber waste is carried downwardly with the air to the lower portion of the creel stand, and is there collected upon the outer surface of filter 99. As the filter rotates, the fiber waste upon its outer surface is withdrawn into fiber waste remover 120 via a flexible tube **103*a***.

An important feature of the present invention is that the fiber waste collected by the aforesaid three types of fiber waste collectors (i.e., the top collector 22, bottom collector 64 and creel collector 98) are removed from the knitting unit by a single fiber waste remover 120. Fiber waste remover 120 and top collector 22, bottom collector 64 and creel collector 98 are respectively interconnected by flexible conduits or tubes **25*g*, 67*a* and 103*a*, respectively, as previously described. While fiber waste remover 120** is shown in the drawings at a location adjacent creel stand B, it may of course be at any desired location. For example, it may be adjacent knitting machine A or in a room or area other than that within which the knitting machine and creel stand are located.

Figure 17:
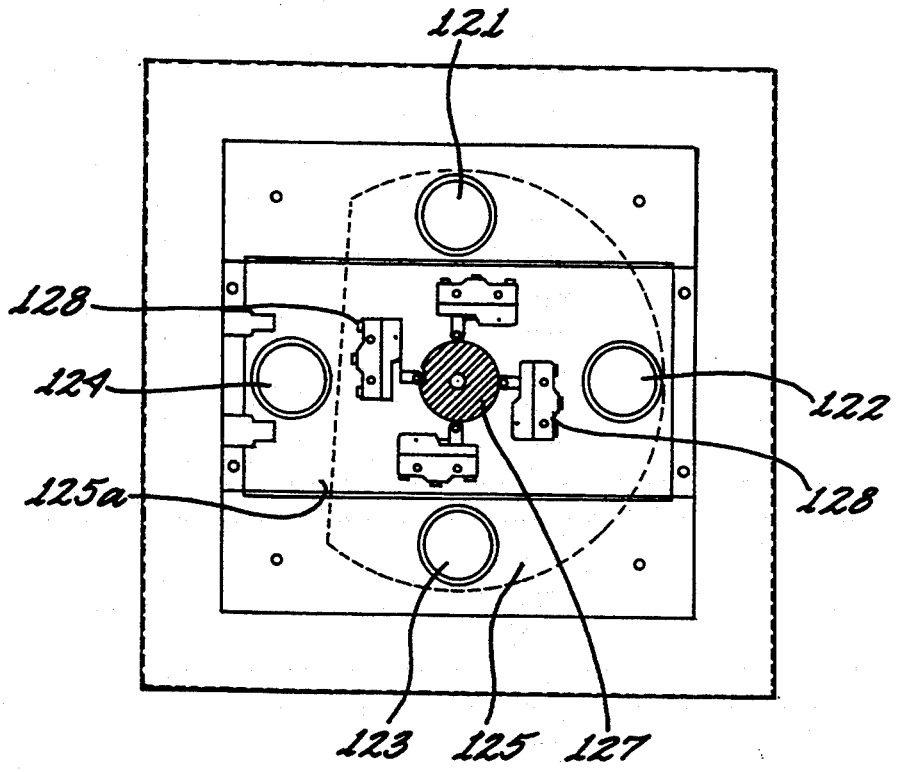
FIG. 17 is a top plan view of the fiber waste remover of FIG. 16.

As is best shown in FIG. 17, four suction openings 121, 122, 123, and 124 extend through the top of the fiber waste remover. Three of the openings are respectively connected to the flexible tubes extending to top collector 22, bottom collector 64 and creel collector 98. The fourth opening may be connected to, e.g., a creel collector of another creel stand (not shown). The number of creel stands and creel collectors employed will differ depending on the number of yarn feeders of the associated knitting machine.

Figure 16:
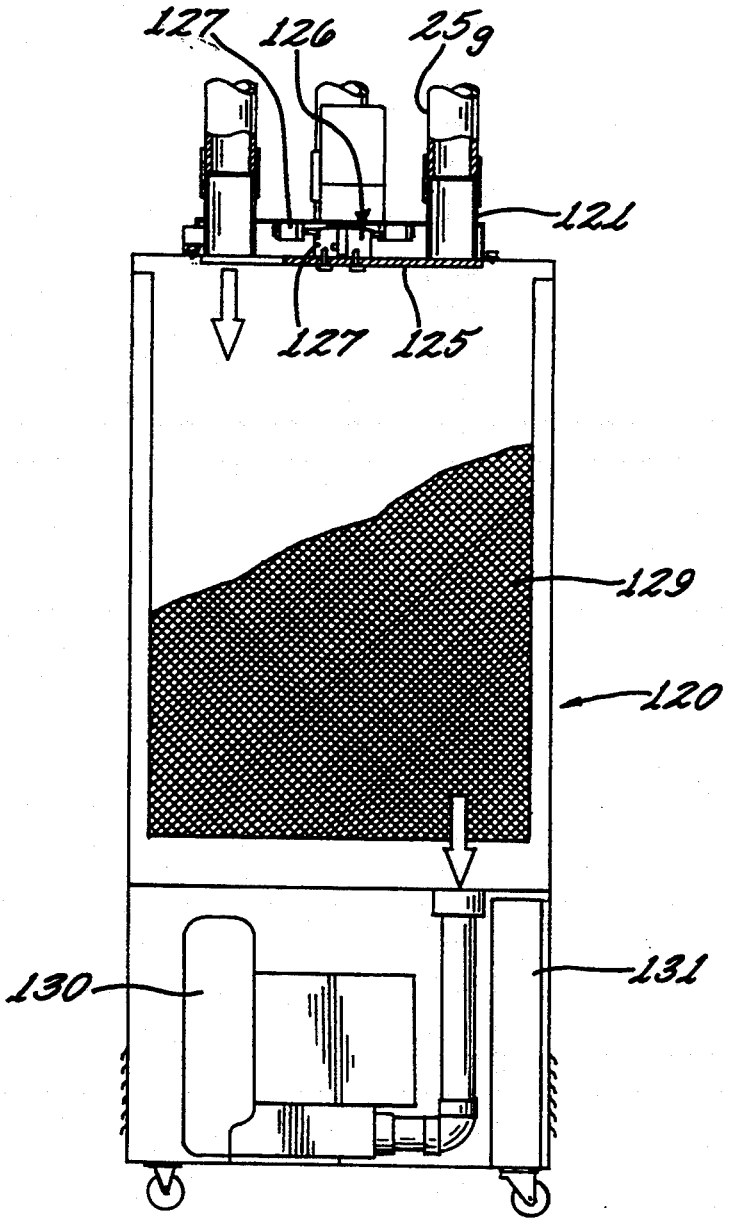
FIG. 16 is an elevational view of a fiber waste remover in accordance with the invention, part of the remover being partially broken away to reveal interior details.

The suction forces generated by fiber waste remover 120 are switched to desired ones of suction openings 121–124 by a disc-shaped change-over plate 125 (FIG. 17) having a cut-away sector **125*a*. Rotative movement is imparted at desired times and to desired extents to plate 125 and a circular switch cam 127 by a motor 126 drivably connected to such components. Cessation of the rotation of plate 125 at any selected position is effected by control means that includes plate-position detection switches 128 fixed to gear motor 126. When the cut-away sector 125*a* of change-over plate 125 underlies one of the openings 121–124, suction forces generated by remover 120 suck fiber waste through the overlying opening, and the tube connected to it, into fiber waste remover 120. The fiber waste thus entering collector 120 is received within a fiber waste box 129. A suction generating device 130 of collector 120 produces a downward air flow indicated by the directional arrows in FIG. 16. A control unit 31 is also illustratively housed within the lower part of control unit 120**, but might alternatively be associated with either knitting machine A or creel stand B.

Figure 18:
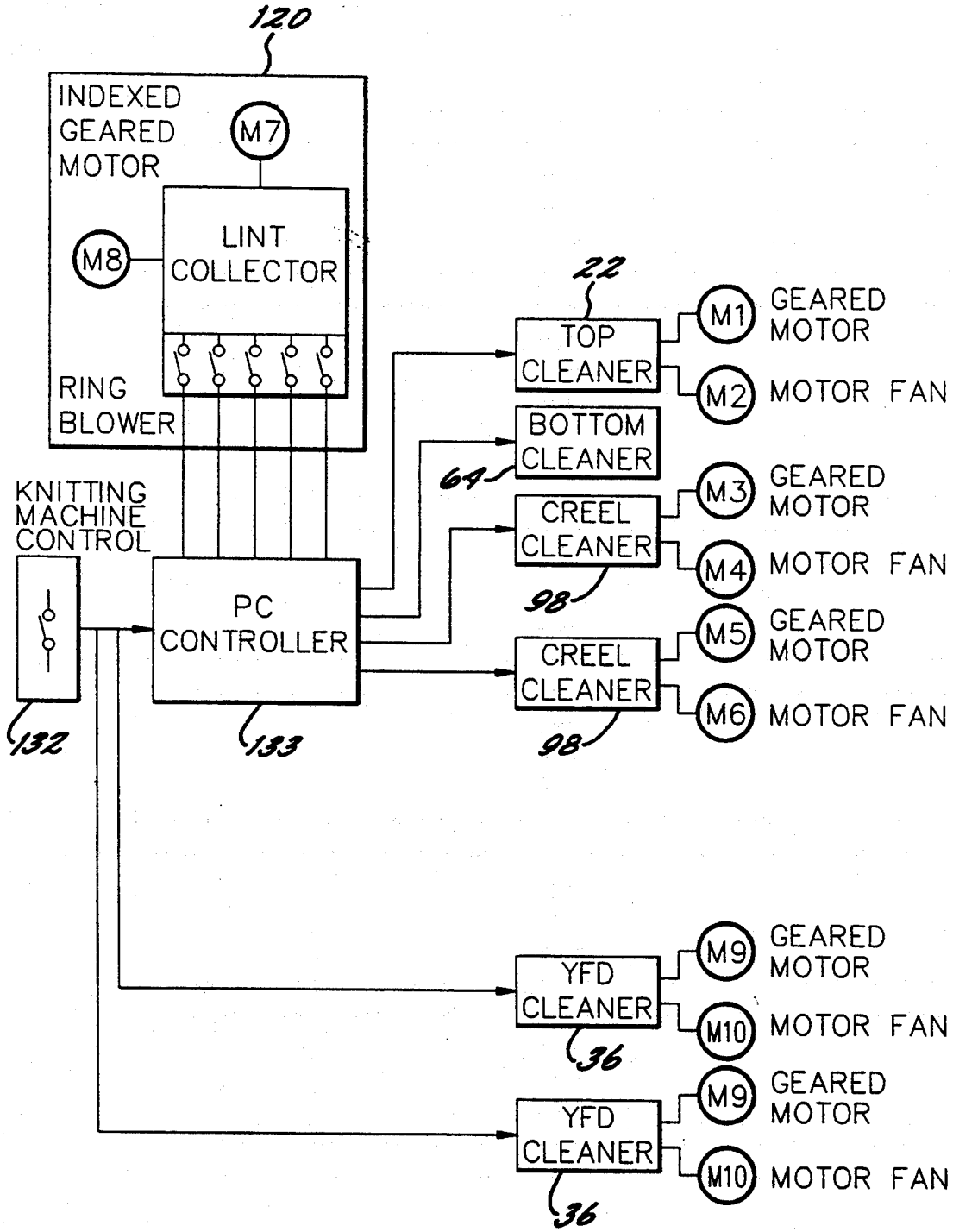
FIG. 18 is a block diagram of components for controlling fiber waste removal in accordance with the first embodiment of the invention.

A first embodiment of controller 131 and associated components is diagrammatically shown in FIG. 18. Controller 133 controls the previously-discussed fiber waste collectors 22, 64 and 98, and the switching between them of the suction forces generated by fiber waste remover 120.

Figure 19:
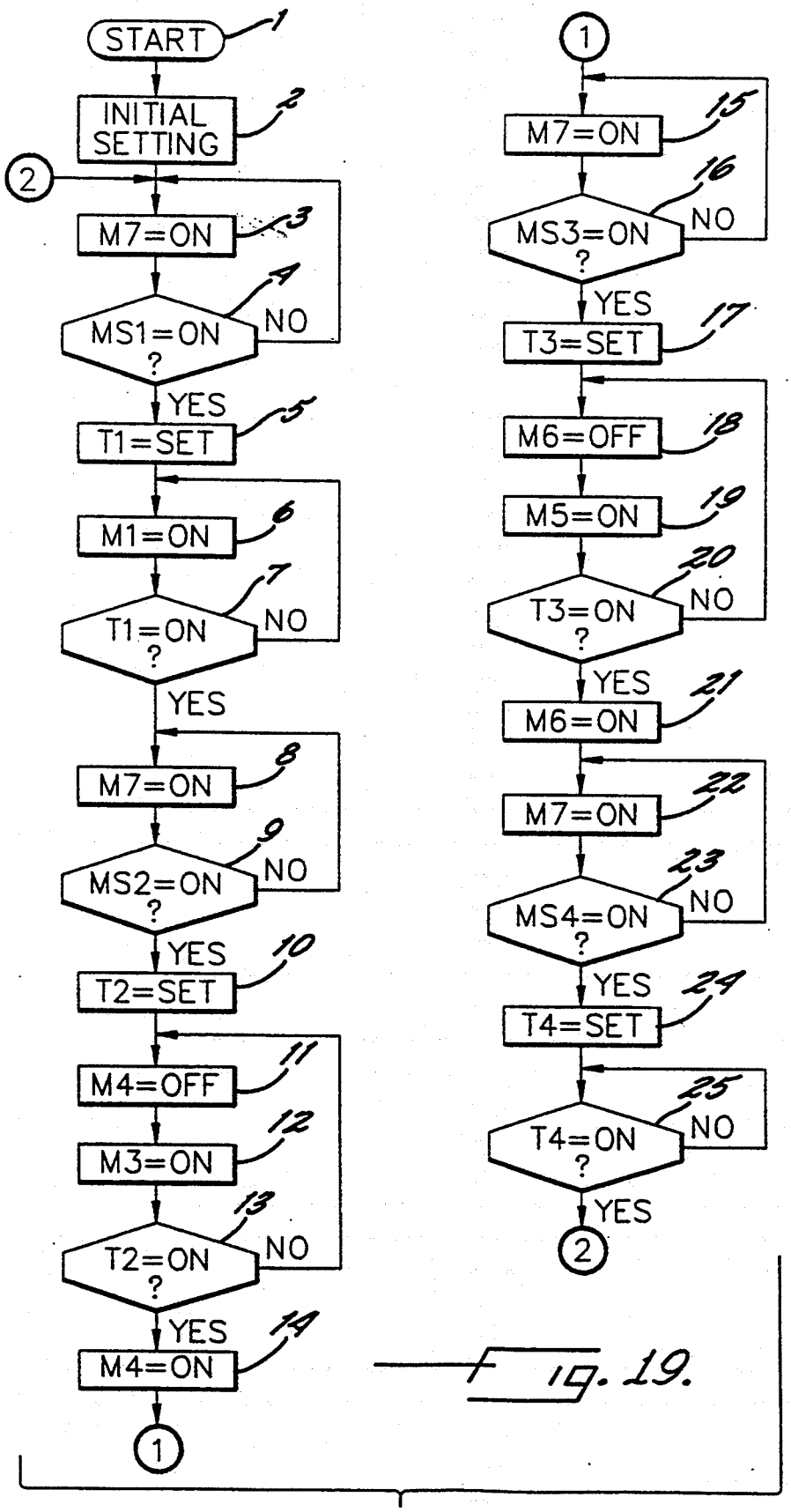
FIG. 19 is a flow chart illustrating operation of the method of fiber waste removal in accordance with the first embodiment of the invention.

FIG. 19 of the drawings shows in diagrammatic form and in numbered steps a method of operation of the fiber waste collecting and removing apparatuses of the invention. The steps are described below:

Step 1: a start signal from knitting machine control unit 132 is received by controller 133.

Step 2: controller 133 activates the motor fan M2 associated with top collector 22, the motor fan M4 associated with a first creel collector 98, the motor fan M6 associated with a second creel collector 98, the motor M8 associated with bottom collector 64, and a motor M10 that starts operation and movement of the side blowing fans of the knitting machine, which in turn starts fiber waste collection simultaneously with operation of the knitting machine.

Step 3: Motor M7 (which is previously described motor 126) is activated to move plate 125 of fiber waste remover 120 to a position wherein the open section of the plate underlies the desired ones of the suction openings of fiber waste remover 120.

Step 4: After a selection switch MS1 for the desired suction opening position is activated, gear motor 126 stops so that the open sector of plate 125 underlies the desired suction opening.

Step 5: The time required for removal of the fiber waste collected by top collector 22 is set and controlled by a timer T1 (FIG. 19).

Step 6: The motor M1 for driving the nozzle that collects the filter of top collector 22 is activated.

Step 7: The fiber waste collected by the filter of top collector 22 is withdrawn into remover 120, until timer T1 times out.

Step 8: Motor 7 is again driven for selecting the next suction opening of fiber waste collector 120 to be aligned with cutout section 125*a* of plate 125.

Step 9: After select switch MS2 for the suction opening position is activated, motor M7 stops plate 125 at a position in which plate section 125*a* underlies the desired suction opening for a first creel collector.

Step 10: The time necessary for withdrawing the fiber waste collected by the filter of the creel collector is set, and begins to run.

Step 11: The fan motor M4 associated with the first creel collector is temporarily stopped to enhance the efficiency of the withdrawal of fiber waste from such collector.

Step 12: A motor M3 associated with the first creel collector is activated and drives the fiber waste removing nozzle adjacent the filter.

Step 13: Fiber waste collected on the filter of the first creel collector is withdrawn into remover 120, until the time set by timer T2 expires.

Step 14: The fan motor M4 associated with the first creel collector, which fan motor was temporarily stopped in Step 11, is again driven.

Step 15: Motor M7 is again driven so as to rotate plate 125 to the next desired suction opening position.

Step 16: Actuation of one of the selection switches MS3 stops motor M7 when the suction opening for the second creel collector overlies plate section 125*a*.

Step 17: The time required for withdrawing the fiber waste collected by the filter of the second creel collector is set and begins to run.

Step 18: A fan motor M6 for the second creel collector is temporarily stopped to enhance the efficiency of the withdrawal of the fiber waste from the second creel collector.

Step 19: Activation of motor M5 drives the suction nozzle of the second creel collector.

Step 20: The fiber waste collected by the filter of the second creel collector is withdrawn into remover 120 until the preset time of timer T3 times out.

Step 21: The fan motor M6 associated with the second creel collector, which was stopped at Step 18, is again driven.

Step 22: The motor M7 is again driven so as to move plate section 125*a* beneath another suction opening of remover 120.

Step 23: A selection switch MS4 for selecting the suction opening position is activated, stopping gear motor M7 when the desired suction opening is reached.

Step 24: The time required for withdrawal of the fiber waste collected in the fiber waste box of the bottom collector is set on a timer T4, and begins to run.

Step 25: The fiber waste collected in the fiber waste collecting box of the bottom collector is withdrawn into remover 120 until the preset time of timer T4 runs out. Thereafter, the process returns to Step 3.

A motor M9 adapted to drive the blower 36 which undergoes reciprocal movement automatically reverses the blower's movement when a switch 46 (FIG. 5) is actuated by a switch cam 47.

Figure 20:
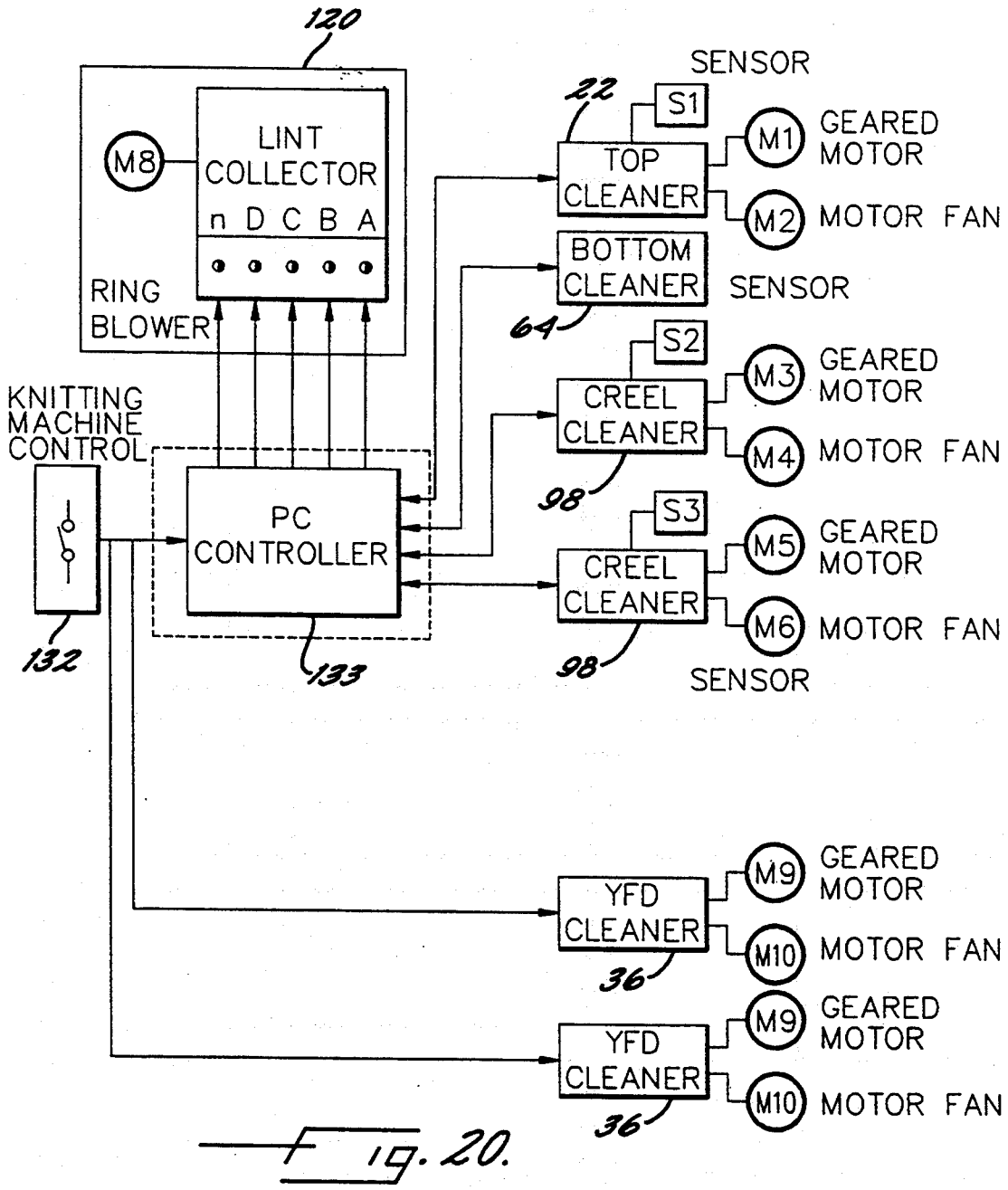
FIG. 20 is a block diagram of components for controlling operation of the fiber waste removal system in accordance with a second embodiment of the invention.

FIG. 20 shows a second embodiment of a controller. It differs from the first embodiment in that it includes sensors S1, S2 and S3 for detecting the amount of fiber waste collected by respective ones of the fiber waste collectors. The sensors may be "FAN ALARM" sensors FD-2M100 manufactured and sold by Tohoku Metal Industries Co. Ltd. Such sensors have a heater and a thermal lead switch that detect variations in the air flow between such components. Since the air flow through the fiber waste collectors decreases in relation to the amount of fiber waste collected by them, the sensors therefore can be and are used to detect the amount of accumulated fiber waste in each collector. When a preselected amount of fiber waste has been collected in one of the fiber waste collectors, the fiber waste is automatically removed from the collector by the fiber waste remover. To assist in implementation of the foregoing, individual and independently controllable solenoid valves A, B, C and D are provided adjacent the suction openings of the fiber waste remover. By removing the fiber waste from each collector only when the amount of such material reaches a preselected amount, rather than removing the fiber waste periodically irrespective of the fiber waste of the amount accumulated, significant energy savings are achieved.

Figure 21:
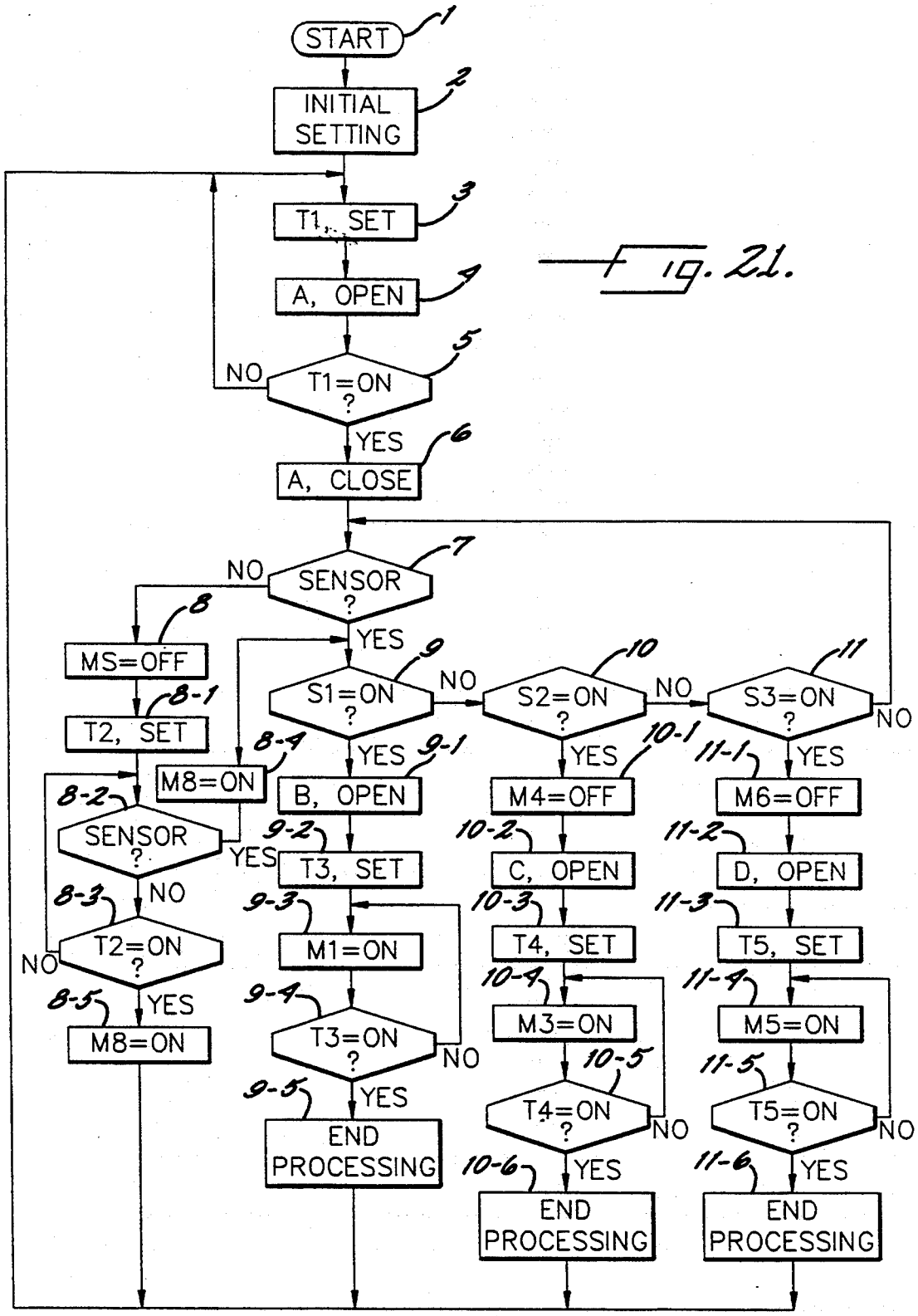
FIG. 21 is a flow chart illustrating operation of the method of effecting fiber waste collection and removal in a second embodiment of the invention.

The following description of the operation of the fiber waste collector/remover of the invention is described with reference to the flow chart of FIG. 21:

Step 1: A start signal is transmitted from knitting machine control unit 132 (FIG. 18) to the control system.

Step 2: (See also FIG. 18) Individual fan motors M2 (for the top collector), M4 (for the first creel collector), M6 (for the second creel collector), M8 (for the bottom collector), and M10 (for the side blower fan which undergoes reciprocal movement) are actuated to start fiber waste collection simultaneously with operation of the knitting machine.

Step 3: Timer T1 is set and begins to run.

Step 4: The fiber waste discharge port A of the fiber waste collection box of the bottom collector is opened by removal of its cap.

Step 5: Fiber waste is withdrawn from the bottom collector, until the preset time of timer T1 times out.

Step 6: Simultaneously with the timing out of timer T1, discharge port A is closed by replacement of the cap thereon.

Step 7: Operation of the individual sensors located adjacent each collector filter is verified. If no signal is present, proceed to Step 8 (energy-saving routine). If a signal is present at Step 7, confirm the identity of the sensor from which the signal emanates, among the sensors for Step 9 (top collector), Step 10 (the first creel collector) or Step 11 (the second creel collector), and execute the pertinent routine. In the present instance, proceed to Step 9.

Step 8: This step saves energy by temporarily stopping motor MS of the fiber waste collecting box, when no sensor signal is present. (The motor M8 is turned off.)

Step 8-1: Set and initiate operation of timer T2.

Step 8-2: Recheck sensors for signal generation. If no signal is present, move to Step 8-3. If any signal is present, proceed to Step 9.

Step 8-3: Until the preset time of timer T2 times out, withdrawal of fiber waste from the fiber waste collecting box is suspended so as to save energy. If any sensor signal is received by the procedure of Step 8-2 during the down time, proceed to Step 8-4.

Step 8-4: With the motor M8 or the fiber waste collecting box turned on, the intended routine is promptly run.

Step 8-5: If the preset time of timer T2 has timed out, without receiving any signal from any of the sensors, return to Step 3, with the motor M8 for the bottom collector turned on, to repeat the loop.

Step 9: This step refers to the routine run when the signal is received from the sensor S1 for the top collector. When the signal is received from the sensor S2 adjacent the creel collector 1, proceed to Step 10.

Step 9-1: The fiber waste discharge port B of the fiber waste collecting box for the top collector is opened by uncapping it. A timer T3 is set and commences to run.

Step 9-2: Set and start timer T3.

Step 9-3: A motor M1 for moving the nozzle that collects the filter of the top collector is actuated.

Step 9-4: Repeat this loop, until the time preset on timer T3 has timed out, and then suck the fiber waste from the top collector into the fiber waste collecting box.

Step 9-5: Perform the terminal procedure by shutting down motor M1 and closing the port B of the fiber waste collecting box by capping such port.

Step 10: This step relates to the routine that is to be run when a signal is received from the sensor S2 adjacent the first creel collector. When the signal is received from a sensor S3 adjacent the second creel collector, proceed to Step 11.

Step 10-1: Shut down fan motor M4 of the first creel collector.

Step 10-2: Open the fiber waste withdrawing port C of the waste collecting box for the first creel collector by uncapping such port.

Step 10-3: Set a timer 4 and initiate its operation.

Step 10-4: Drive a motor M3 for the filter which rotates adjacent the suction nozzle of the creel collector.

Step 10-5: Repeat this loop, until the time preset on timer T4 has timed out, to withdraw the fiber waste in the first creel collector into the fiber waste collecting box of the fiber waste remover.

Step 10-6: Perform the terminal procedure for returning to Step 3 (shut down motor M3 for the nozzle, close port C of the waste collecting box by capping it, and drive fan motor M4).

Step 11: This step relates to the routine to be run when a signal is received from a sensor placed adjacent the second creel collector 3. If the signal is received from any one of the sensors other than the sensor S3 adjacent the second creel, return to Step 7.

Step 11-1: Shut down fan motor M6 of the second creel collector.

Step 11-2: Open the fiber waste withdrawing port D of the fiber waste collecting box for the second creel collector, by uncapping such port.

Step 11-3: Set and initiate operation of a timer T5.

Step 11-4: Drive the motor MS for the filter which rotates adjacent the suction nozzle of the creel collector.

Step 11-5: Repeat this loop, until the time set on timer T5 has timed out, to withdraw the fiber waste from the second creel collector into the waste collecting box of the fiber waste remover.

Step 11-6: Perform the terminal procedure for returning to Step 3 (shut down nozzle drive motor M5, close port D of the fiber waste collecting box by capping the same, and drive fan motor M6).

It should be noted that the motor 9 (not shown in the flowchart) which drives the blower fan motor and is adapted to undergo reciprocal movement automatically reverses the direction of movement of the blower fan motor, as previously described.

Test Results

The efficacy of the fiber waste collection and removal in accordance with the present invention has been tested experimentally under the following conditions:

Machine type: XC-Z/3SS 30 inches manufactured by Precious Fukuhara Work Ltd.
Number of revolutions: 51 rpm
Integrated number of revolutions: 8000
Type of yarn: Cotton card yarn 30/1
Total weight of knit cloth: 93.3 kg
(Test method)

(1) Cover the knitting machine and the creel stand completely with a vinyl sheet, to segregate them off from the ambient atmosphere.

(2) Withdraw into a single remover the fiber waste which has accumulated in the top collector, bottom collector and creel collector.

(3) Weigh the fiber waste thus withdrawn, after washing and drying it.

(Result of withdrawal)
Amount of flocks withdrawn: 101.00 g
Amount not withdrawn: 13.36 g
(Breakdown: Floor, 6.88 g: knitting machine, 2.00 g; bottom of creel stand, 4.488).
Total amount of fiber waste: 114.36 g.
Recovery of fiber waste by the apparatus and method of the invention: 88.3%.

For persons who are familiar with the actual condition of knitting plants, the recovery of close to 90% of the generated fiber waste is amazing. Moreover, with use of the invention the overall system is simplified, because fiber waste is centrally withdrawn into a single remover. Furthermore, the fiber waste collection may be performed periodically from successive collectors or nonperiodically, depending on the amount of flocks collected in each collector, thus contributing to energy saving.

While preferred embodiments of the invention have been shown and described, this was for purposes of illustration only, and not for purposes of limitation, the scope of the invention being in accordance with the following claims.

We claim:

1. A method of collecting fiber waste from a knitting unit including a fiber waste remover, and a creel having a fiber waste collector, the unit further including a knitting machine having a knitting section, a top fiber waste collector above the knitting section, and a bottom fiber waste collector adjacent the knitting section, comprising:

selectively and sequentially conducting fiber waste from different ones of said fiber waste collectors to said fiber waste remover for time periods correlated to the amount of fiber waste in respective ones of said fiber waste collectors.

2. A method of collecting fiber waste from a knitting unit including a creel having a creel fiber waste collector, the unit further including a knitting machine having a knitting section, a top fiber waste collector above the knitting section, and a bottom fiber waste collector adjacent the knitting section, the knitting unit further including a fiber waste remover having a multi-position valve for selectively connecting said fiber waste remover to different ones of said fiber waste collectors, the method comprising:

sensing when the fiber waste collected by any one of the fiber waste collectors exceeds a predetermined amount, and moving the multi-position valve to a position connecting such fiber waste collector to the fiber waste remover.

3. The method of claim 1, and further including terminating removal of fiber waste from the selected fiber waste collector when withdrawal of the fiber waste from the fiber waste collector has been completed.

4. The method of claim 1, and further including terminating removal of fiber waste from the selected fiber waste collector upon expiration of a predetermined time period.

5. A method of collecting and removing fiber waste from a knitting unit, including a creel, a knitting machine, a plurality of discrete fiber waste collectors situated at mutually spaced locations within said knitting unit, and a fiber waste remover selectively connectable to different ones of the fiber waste collectors, comprising:

connecting each of the fiber waste collectors at different times to different ones of the fiber waste collectors and conducting fiber waste from each of the collectors to the fiber waste remover.

6. A method as in claim 5, and further including sensing when the amount of fiber waste collected by any one of said fiber waste collectors exceeds a predetermined amount.

7. A method as in claim 5, and further including terminating the conduction of the fiber waste from the fiber waste collectors when the amount of fiber waste within a fiber waste collector is less than a predetermined amount.

8. A method as in claim 5, and further including terminating the withdrawal of fiber waste from each of the fiber waste collectors after a predetermined time interval.

* * * * *

UNITED STATES PATENT AND TRADEMARK OFFICE
CERTIFICATE OF CORRECTION

PATENT NO. : 5,437,732

DATED : August 1, 1995

INVENTOR(S) : Igarashi et al.

It is certified that error appears in the above-identified patent and that said Letters Patent is hereby corrected as shown below:

Column 7, line 30, after "rotation" insert --.--.

Column 12, line 62, "MS" should be --M8--.

Column 13, line 64, "MS" should be --M5--.

Column 14, line 19, "Precious" should be --Precision-- and "Work" should be --Works,--.

Column 15, line 16, "claim 1" should be --claim 2--.

Column 15, line 20, "claim 1" should be --claim 2--.

Signed and Sealed this

Eleventh Day of June, 1996

*Attest:*

Bruce Lehman

BRUCE LEHMAN

*Attesting Officer*

*Commissioner of Patents and Trademarks*